US007218225B2

(12) United States Patent
Wieth et al.

(10) Patent No.: US 7,218,225 B2
(45) Date of Patent: May 15, 2007

(54) SYSTEM AND METHOD FOR DETECTING AND REWARDING THE RETURN OF A SUPERMARKET TROLLEY OR A LUGGAGE TROLLEY TAKEN FROM A TROLLEY PARK

(75) Inventors: Franz Wieth, Puchheim (DE); Horst Sonnendorfer, Puchheim (DE)

(73) Assignee: Systec POS-Technology GmbH, Puchheim (DE)

( * ) Notice: Subject to any disclaimer, the term of this patent is extended or adjusted under 35 U.S.C. 154(b) by 154 days.

(21) Appl. No.: 10/495,589

(22) PCT Filed: Nov. 15, 2002

(86) PCT No.: PCT/EP02/12830

§ 371 (c)(1),
(2), (4) Date: Oct. 26, 2004

(87) PCT Pub. No.: WO03/042814

PCT Pub. Date: May 22, 2003

(65) Prior Publication Data

US 2005/0072651 A1 Apr. 7, 2005

(30) Foreign Application Priority Data

Nov. 16, 2001 (DE) ..... 101 56 271

(51) Int. Cl.
*G08B 13/14* (2006.01)

(52) U.S. Cl. ..... 340/568.5; 340/572.1; 186/62

(58) Field of Classification Search ..... 340/988
See application file for complete search history.

(56) References Cited

U.S. PATENT DOCUMENTS

| | | | | |
|---|---|---|---|---|
| 3,837,455 | A * | 9/1974 | Hurt | 194/211 |
| 3,882,982 | A * | 5/1975 | Smith | 194/211 |
| 3,897,863 | A * | 8/1975 | Peggs | 194/212 |
| 3,938,638 | A * | 2/1976 | Moule | 194/211 |
| 4,470,495 | A * | 9/1984 | Unger | 194/205 |
| 4,518,072 | A * | 5/1985 | Muellner et al. | 194/205 |
| 4,576,274 | A | 3/1986 | Thorsen | |
| 5,119,087 | A * | 6/1992 | Lucas | 340/5.92 |
| 5,526,916 | A * | 6/1996 | Amdahl et al. | 194/211 |
| 5,708,782 | A * | 1/1998 | Larson et al. | 705/14 |
| 5,921,373 | A * | 7/1999 | Amdahl et al. | 194/213 |

(Continued)

FOREIGN PATENT DOCUMENTS

DE 195 46 521 2/1997

*Primary Examiner*—Jeffery Hofsass
*Assistant Examiner*—George A. Bugg
(74) *Attorney, Agent, or Firm*—Volpe and Koenig, P.C.

(57) ABSTRACT

A system and a method for detecting and rewarding the return of supermarket carts or luggage carts taken from a cart stand. Each cart is provided with a contactless, preferably optically identifiable, individual mark, by which the cart is identified when it is returned to a cart stand. In addition, the identifying mark on the cart changes when the cart is brought back to the cart stand, from an active state, in which the mark can be identified, to a passive state, in which the mark cannot be identified, or vice-versa. In addition to the presence of a returned cart, the invention enables the correct positioning of a cart in a row of nested carts to be identified in a contactless and automatic manner.

25 Claims, 6 Drawing Sheets

Figure 1:
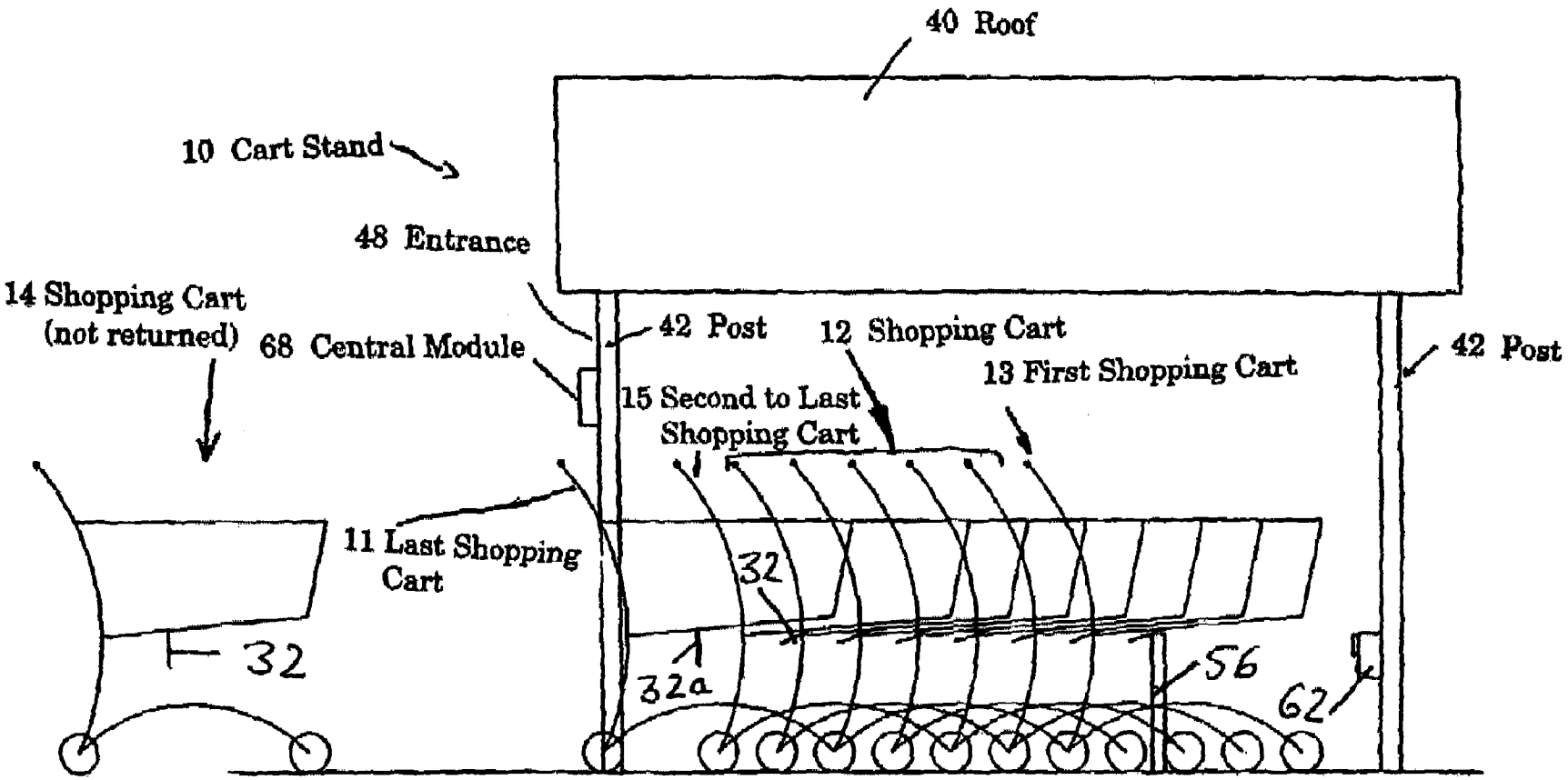

U.S. PATENT DOCUMENTS 5,950,792 A * 9/1999 DiPaolo ..... 194/205
6,024,203 A * 2/2000 Amdahl et al. ..... 194/213
6,125,985 A * 10/2000 Amdahl et al. ..... 194/205
6,142,283 A * 11/2000 Amdahl et al. ..... 194/205
6,206,165 B1 * 3/2001 Lenander ..... 194/213
6,378,684 B1 * 4/2002 Cox ..... 194/213
6,486,768 B1 * 11/2002 French et al. ..... 340/5.92
6,975,205 B1 * 12/2005 French et al. ..... 340/5.92
2002/0121547 A1 9/2002 Wieth et al.
2002/0121977 A1 9/2002 Wieth et al.
2002/0121978 A1 9/2002 Wieth et al.

* cited by examiner

SYSTEM AND METHOD FOR DETECTING AND REWARDING THE RETURN OF A SUPERMARKET TROLLEY OR A LUGGAGE TROLLEY TAKEN FROM A TROLLEY PARK

The invention relates to a system for detecting and rewarding the return of a shopping cart or luggage cart taken from a cart stand according to the preamble of claim 1. It also relates to a corresponding method according to the preamble of claim 25.

Accordingly, the system includes a number of shopping carts, which are each provided with a non-contact, individual marking that can be identified; at least one cart stand for the shopping carts; and detection means arranged in the region of the cart stand for identifying the markings of the shopping cart, with the detection means being equipped so that they generate a signal for issuing a bonus when they detect a shopping cart has been returned.

In the following, the term "shopping cart" is meant to apply not only to shopping carts in the strict sense, but also to luggage carts or transport carts.

Self-service shopping markets are usually interested in each customer using a shopping cart. For this purpose, shopping carts are normally kept ready in cart stands, from which the customer removes a cart and then can take it along with them into the shopping market. However, the motivation of customers to bring the used shopping cart back to the cart stand after completing his shopping is very low according to experience. Instead, the shopping carts are often left standing where they are unloaded, normally in the middle of the shopping market's parking lot. This results in multiple costs for the shopping market, because personnel must be provided for collecting the abandoned shopping cart. In addition, abandoned shopping carts always present the risk of damaging parked vehicles and the like.

To give the customer an incentive to return the used shopping cart to the cart stand, shopping carts are commonly provided with security locks. In this way, the customer can take a shopping cart from the cart stand only when he places a coin deposit or the like in the security lock. The coin deposit is released only when the shopping cart is returned properly to the cart stand. In addition to the annoyance, which is disadvantageous to the shopping mood of the customers and which results when the customer does not have the required coin deposit, many customers feel that the security lock system is also unpleasant guiding and micromanaging.

To avoid these disadvantages of the security lock system, in WO 98/51197 an electronic system for detecting and rewarding the return of shopping carts was proposed, in which each shopping cart is provided with an electronic transmitter-receiver device. With the help of this device, by means of detection means in the shopping market, especially at the cash register and at the cart stands for the shopping carts, the path of each shopping cart is tracked and stored. A central data processing device recognizes when a shopping cart has passed the cash register and arrives at the cart stand and as a result it issues a bonus in the form of a credit note or a lottery ticket. However, the electronic transmitter-receiver devices, which must be mounted on each shopping cart, results in considerable additional costs for the initial fitting and considerable maintenance costs due to the required mobile power supply. In addition, shopping carts are often not handled very gently, so that frequent disruptions to these transmitter-receiver devices must be taken into account.

Therefore, in WO 01/82241 it was proposed that instead of providing the shopping carts with electronic transmitter-receiver devices, the shopping carts would each be provided with an individual marking that can be identified optically, with reference to which the presence of a shopping cart both in the shopping market and also in the cart stand can be recognized with optical means. Such an individual marking of a shopping cart can be embodied as a purely passive reflector, which means cart stand must be equipped either with a signal transmitter or with a detector.

In contrast with the conventional deposit systems, one problem in these non-contact return systems is that it is unfavorable when the customers put away the shopping carts any which way in the cart stand and still receive the bonus for the return of the shopping cart. Instead, it should be guaranteed that the customers put away the shopping carts properly in the cart stand, which generally means that the shopping cart is pushed into a row of nested shopping carts formed in the cart stand. In WO 01/82241 this problem has already been recognized; it was proposed to program a digital camera so that it recognizes the handle of the shopping cart and can report to the detection means whether the shopping cart is positioned with its handle within a predetermined tolerance in the row of handles of the corresponding row of nested shopping carts, which should trigger a bonus.

The individual processing steps, conditions, and requirements for issuing a bonus for the return of a shopping cart within a non-security-lock system have already been described, especially in the just cited publications in the state of the art, as well as in WO 01/82239 and WO 01/82240, and to this extent are known.

The present invention is based on the task of further improving a shopping cart return system and a corresponding method of the type mentioned in the introduction and is especially based on the task of detecting the condition of proper placement of the shopping cart in the cart stand provided for this purpose as inexpensively as possible and nevertheless reliably.

This task is achieved by a system with the features of claim 1 and also by a method with the features of claim 25.

Advantageous configurations and refinements of the system according to the invention are found in claims 2–24.

Therefore, the invention differs from already known return systems in that the marking of the shopping carts can be changed from an active state, in which the marking can be identified by the detection means, into a passive state, in which the marking cannot be identified by the detection means, and/or vice-versa the marking of the shopping cart can be changed from the passive state into the active state, with the change from the active to the passive state or from the passive to the active state preferably taking place in connection with the placement of the shopping cart in a cart stand.

This configuration of the markings of the shopping carts according to the invention enables the detection means, which can identify the individual marking of each individual shopping cart, to be able to detect not only the presence of each shopping cart, but also to obtain additional information through the "switch-over" of the marking (or also an adjacent marking) from an active to a passive state or vice-versa. Then, when the switch-over from the active to the passive or from the passive to the active state is triggered by a process, which should be recognized by the detection means, this can not only detect and report or further process the presence of a shopping cart, but also the completion of this process.

The process, which leads to additional information, can be especially the proper placement of a shopping cart in the cart stand. Thus, for the issuing of a bonus, it is not sufficient when the detection means recognize the presence of the shopping cart in the cart stand or in the region of the cart stand; instead, the bonus is only issued or the signal for issuing the bonus is only generated when, through switch-over of a marking from the active to the passive state or vice-versa, it is recognized by the detection means that the shopping cart has been placed properly in the cart stand. The switch-over of the marking takes place preferably only when the identified shopping cart is set in a row of nested shopping carts in the cart stand within a predetermined tolerance. However, it is also conceivable for the switch-over of the marking to be activated by other actions of the customer, which should be recognized by the detection means.

In the simplest case, the invention can be realized when the marking of the shopping cart can be identified optically and the detection means are optical detection means. The optical identifiers can be primarily coded sequences of symbols, but other optical identifiers are also conceivable, as already described in WO 01/82241.

For each configuration of the invention, in which additional information is output to the detection means by the switch-over of the marking from the active to the passive state or vice-versa, such that the relevant shopping cart has been placed properly in a row of nested shopping carts in the cart stand, there are different methods of activation or passivation.

In one configuration of the system, the marking of a separated shopping cart, which is not in a row of nested shopping carts, is basically in its active state, which offers additional advantages, such that the shopping carts can also be identified outside of the cart stand, especially in the shopping market or at the cash register, with reference to its marking.

The marking can then change in a first shopping cart from its active (ground) state to the passive state, as soon as a second shopping cart located behind the first shopping cart is pushed into the first shopping cart for forming or adding to a nested row.

Alternatively, the marking can also change in a second shopping cart from its active (ground) state to the passive state, when the second shopping cart is pushed into a first shopping cart located in front of it for forming or adding to a row of nested shopping carts. This takes place preferably exactly when the relevant shopping cart is set properly in the nested row.

In both cases, the switch-over of the identifiers leads to the condition that only the last shopping cart in a row of nested shopping carts has an identifier in the active state. All of the other identifiers of the shopping carts set in front of it in the nested row are switched to the passive state.

This leads to the condition that the invention can be implemented very inexpensively, e.g., by using a pivoting plate as a marking for the shopping cart. Then, e.g., the detection means of each nested row can include a camera, which is arranged at the head of the nested row and which recognizes the identifier of the last shopping cart in the direction along the nested row. As soon as another shopping cart is pushed in the previously last shopping cart, the corresponding plate of the shopping cart, which is now next to last, is flipped over, so that the camera now recognizes and identifies the plate of the just placed shopping cart. The identification of the just replaced shopping cart is then performed only when this has been pushed properly into the nested row so far until the identifier of the shopping cart located in front of it has changed to its inactive state.

Such plates can be arranged on the base of the shopping cart or attached to a usually otherwise provided folding rear wall of the shopping cart, with the plates being pivoted with this rear wall from an essentially vertical position into an essentially horizontal position when another shopping cart is pushed in.

The invention can also be implemented such that the marking of the shopping cart is basically in its passive state when the carts are separated, that is, not in a row of nested shopping carts. Here, the marking of a second shopping cart then changes into its active state when this second shopping cart is pushed into a first shopping cart in front of it. The effect achieved by this is the same: the detection means can always identify only the last shopping cart in a row of nested shopping carts, because only this cart has a marking in the active state, wherein this identification is performed exactly when the associated shopping cart has been placed properly in the nested row.

This can provide advantages, e.g., when the state of the marking of a non-empty shopping cart always remains constant according to another configuration of the invention, thus remains passive in the present case. This prevents any attempts at manipulation, in which the customer moves a not yet unloaded shopping cart into the cart stand, takes the bonus, and then unloads the shopping cart, after which he could then leave the cart unattended.

In one refinement of the just mentioned system, the marking of a second shopping cart can be changed from its passive (ground) state to its active state, when this shopping cart is pushed into a first shopping cart in front of it, but then changes back into its passive state when a third shopping cart located behind the second shopping cart is pushed into the second shopping cart. Here, there is the ability, as in the first alternative, to provide a camera on the end of a row of nested shopping carts, which can then by itself always recognize only the marking of the last, just placed shopping cart, while the markings of all of the shopping carts in front of this one in the nested row can no longer be recognized, because they are in their passive state.

In all of the described embodiments, in order to guarantee the function of the system even for the first shopping cart in each nested row, advantageously at the cart stand there can be an activation device, which changes the state of the marking of the very first shopping cart, thus, as if it had been pushed into a shopping cart in front of it.

On each shopping cart, several markings can also be provided to enable the detection from different directions. Thus, the shopping cart can be detected by the detection means, which work with different orientations.

In addition to the especially preferred optical markings, in all of the described embodiments, it is also conceivable to provide a non-contact electronic marking, especially a transponder on the shopping cart. All that is important is that the transponder can be changed from an active to a passive state and vice-versa. Besides electronic ways, this can also be realized in purely mechanical ways, namely in which the transponder is pivoted when the shopping cart is pushed into a nested row, e.g., such that it comes to rest in a shielded metal housing, or else simply changes its orientation, and thus can no longer be recognized by the detection means or recognized as oriented "incorrectly."

Other special advantages are given when the detection means are embodied such that they recognize when a cart stand is completely full and/or when a cart stand is empty. It is common to observe that customers who park their vehicle in a parking spot, which is at a distance from the shopping market, take their shopping carts from a cart stand near the shopping market, but do not return the carts to this same stand after shopping, but instead use the cart stand nearest their vehicle. This leads to the condition that at regular intervals a lot of rows of nested shopping carts must be brought from distant cart stands to cart stands near the shopping market with corresponding costs for personnel.

If the detection means could decide that a shopping cart has been placed in a cart stand that has already been recognized as completely full or is still added to a nested row located there, then the issuing of a bonus can be refused accordingly.

According to a preferred refinement of this configuration of the invention, such behavior of the customers can be prevented at the beginning and uniform loading of the cart stands can be achieved:

If each cart stand is provided with display elements, which are connected for data exchange to the detection means and can be displayed outwards noticeably, whether a cart stand is empty and/or completely full, the customers can recognize, possibly already from a distance, that they must use a different cart stand to receive a bonus. If the detection means of the individual cart stands are connected to each other for data exchange, a type of guide system can even be realized, with the display elements pointing the customers to the nearest cart stand that is not yet full.

The already mentioned camera as a component of the detection means according to the invention can be equipped with a microprocessor and one or more image-recognition sensors, e.g., CCD or CMOS cameras. The objectives can have electrically adjustable focal lengths. Therefore, the observation range can be divided into several detection ranges, especially distance ranges. This has the advantage that objectives with less high-quality imaging properties, as well as image sensors with lower light sensitivity, can be used. In addition, a controller and movement mechanisms for the focus of the objective are not required, which could present problems, especially at low temperatures.

To compensate for poor lighting conditions, the detection means can be provided with illumination means. This can be realized, e.g., with light-emitting diodes, optionally in the infrared range. To save energy, the illumination means or also the cameras can be triggered by a motion detector, so that the illumination and/or the camera is only put in operation when a shopping cart has actually been placed in the cart stand. Here, the illumination means can also be operated in a flash mode, which further reduces the energy requirements.

The detection means can be have a modular construction, preferably with a central module, with camera modules, and optionally with illumination modules. The central module monitors all of the connected modules and it can control them and exchange information. The central module also controls, in particular, writing and reading devices for a data carrier of a customer in order to credit a bonus to the data carrier, under the use of data detected by the camera modules. Alternatively, the central module can also control a printer, which then issues a printed bonus coupon. The central module is then preferably in the vicinity of the cart stand entrance. A motion detector could also be located there, with whose help the central module controls the camera modules and optionally the illumination module. Thus, the corresponding modules for saving energy can be turned off or set into a rest mode when there is no one in the vicinity of the cart stand.

The central module can further control an acoustic and/or optical display unit to display information to the customer, e.g., on the options for receiving a bonus for the just completed return of the shopping cart, on the successful issuing of the bonus, or on its value. Other information can also be displayed, such as the number of shopping carts in the cart stand, the fact that the cart stand is empty or that it cannot accept any more shopping carts, so that no more bonuses will be issued for additional shopping carts. This information can preferably be made visible from a great distance, e.g., by means of a display device on the roof of the cart stand.

Furthermore, there can be a power-supply module, which is embodied as a power-network part in cart stands, which can be connected to the power network, and which can optionally consist of, e.g., a solar-power module.

With reference to the attached drawings, in the following a few embodiments for a system according to the invention will be described and explained in more detail, with other advantageous configurations of the invention being described.

In the following, the invention is explained in more detail with reference to several figures.

Figure 2:
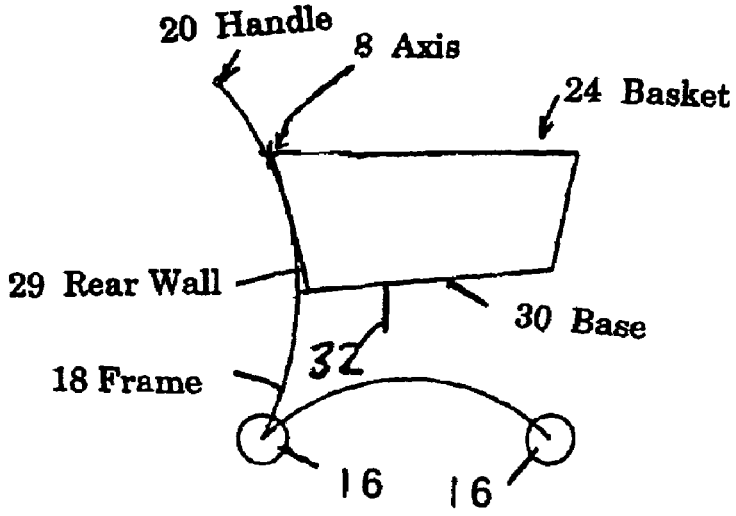
Figure 3:
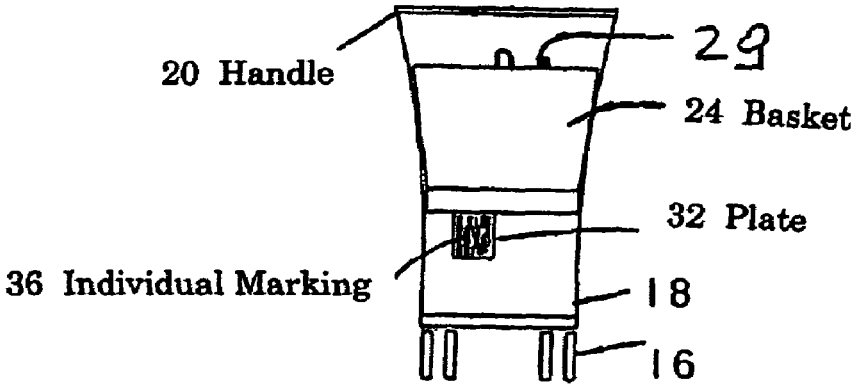
Figure 4:
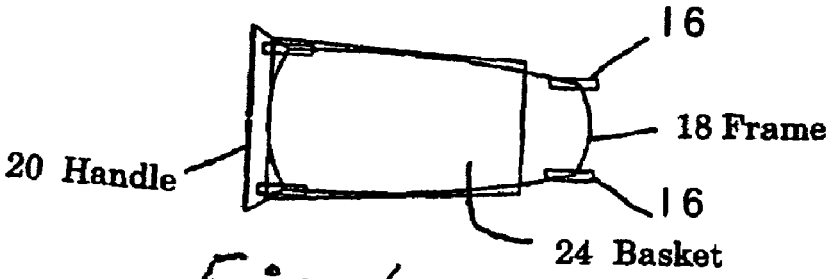
Figure 5:
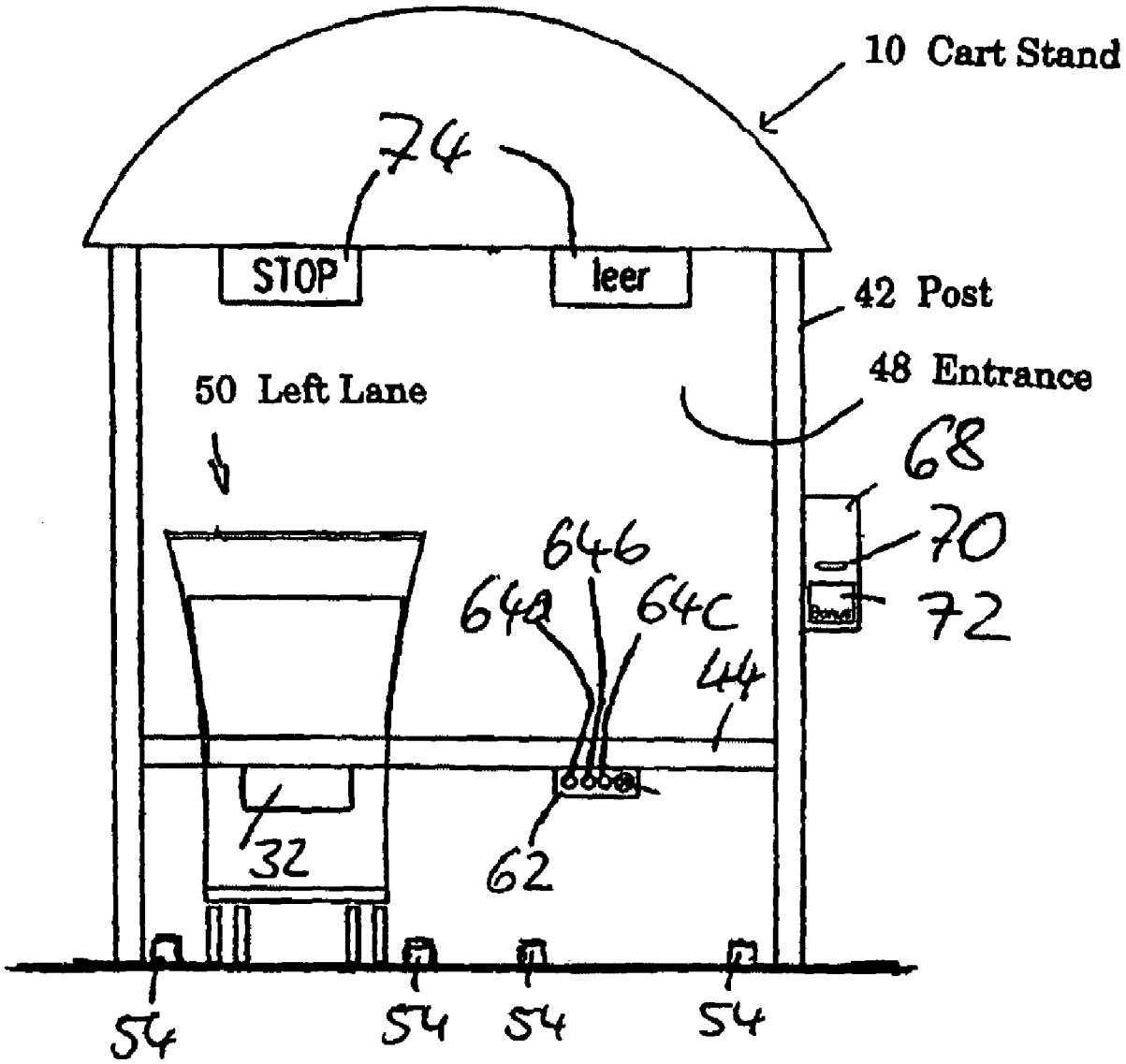
Figure 6:
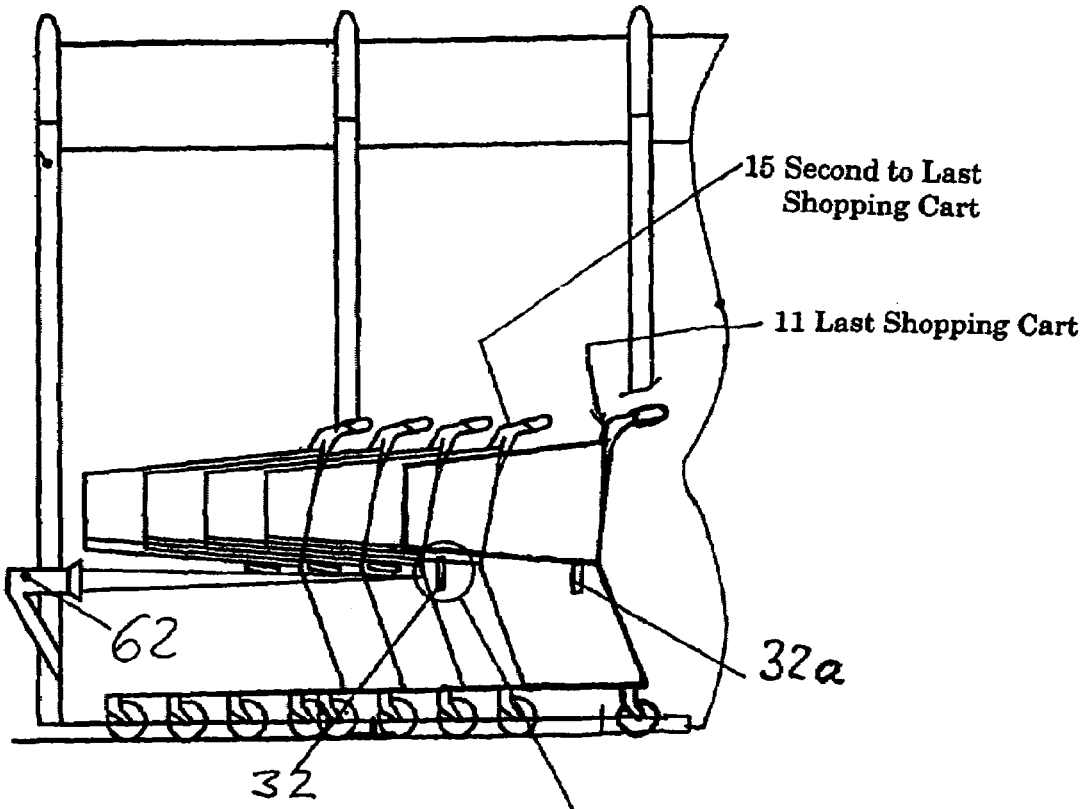
Figure 7:
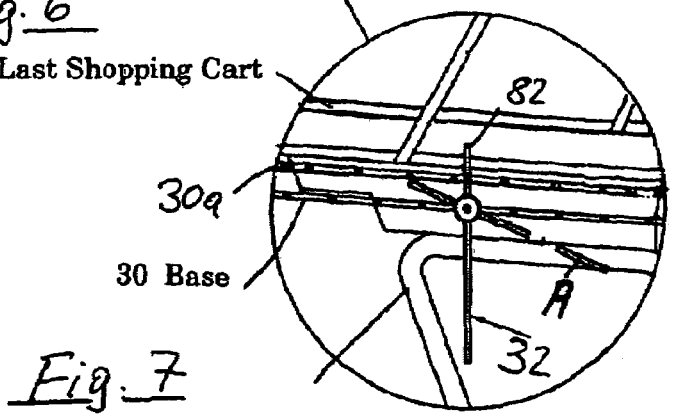
Figure 8:
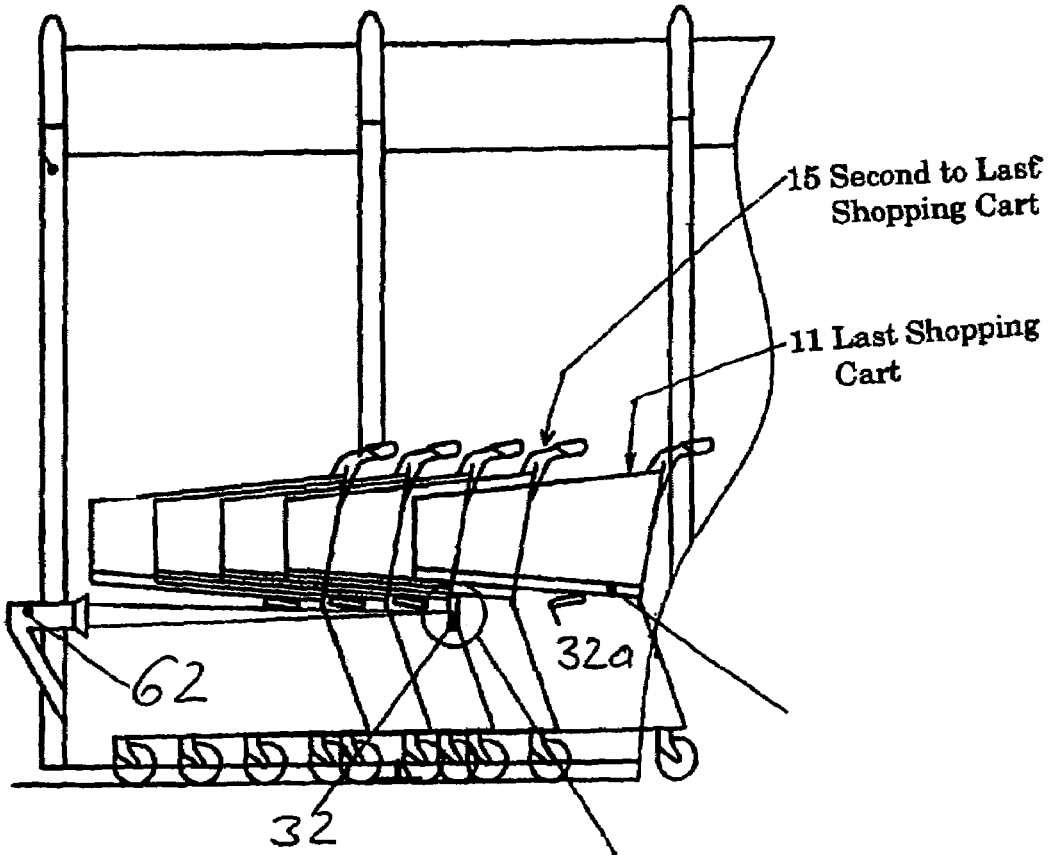
Figure 9:
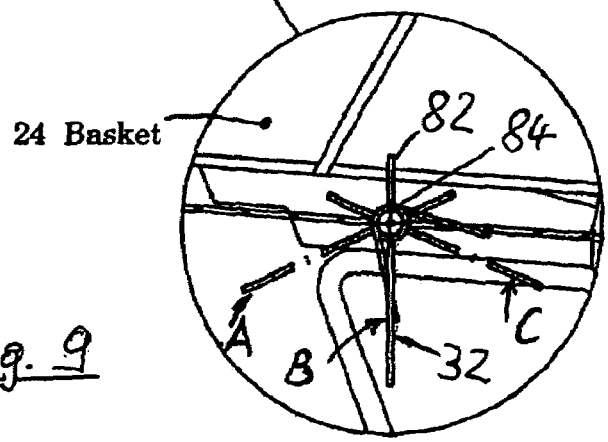
Figure 10:
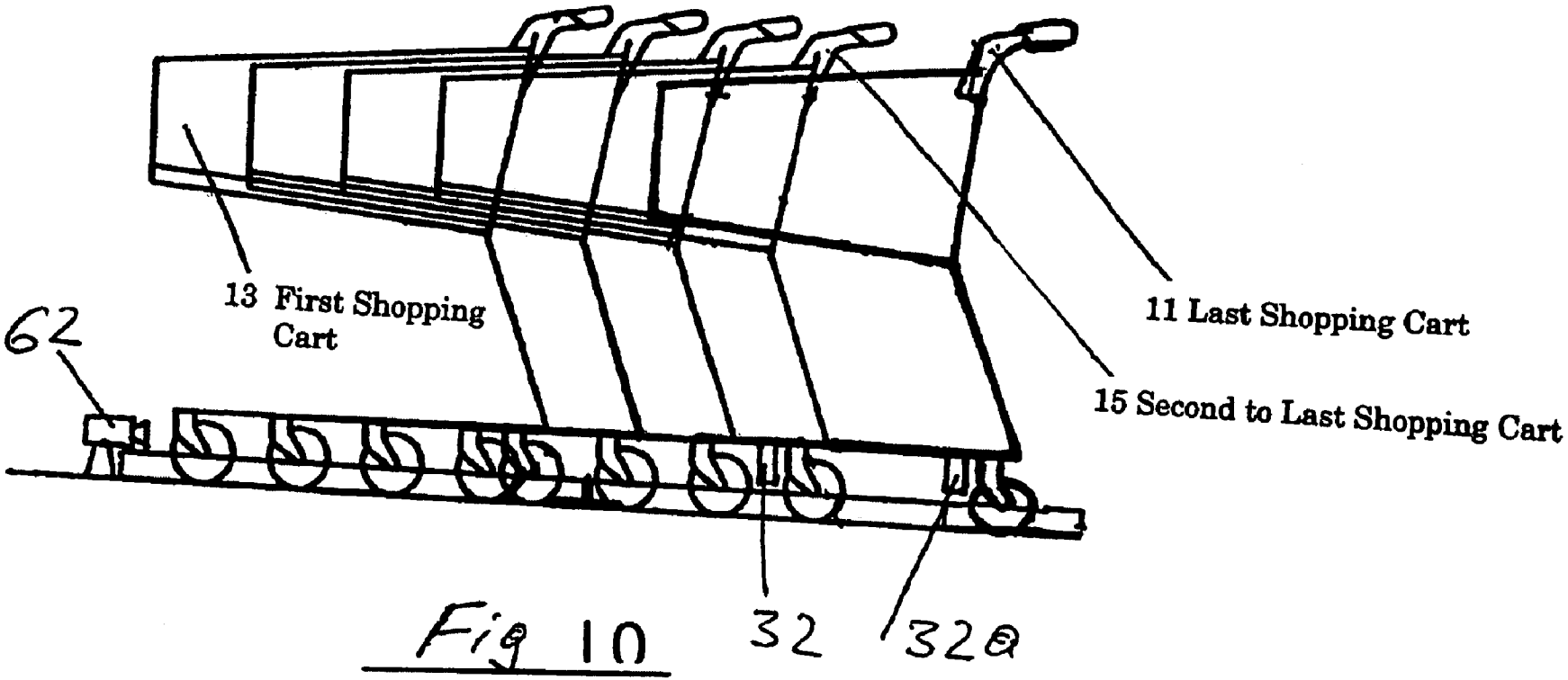

Shown in detail are:

FIG. 1 a cart stand with several shopping carts in side view,

FIG. 2 a shopping cart in side view,

FIG. 3 the shopping cart from FIG. 2 in front view,

FIG. 4 the shopping cart from FIG. 2 in plan view from above,

FIG. 5 the cart stand viewed in the direction of the entrance,

FIG. 6 a cart stand with several shopping carts of a second embodiment,

FIG. 7 a detailed view of the shopping cart according to FIG. 6,

FIG. 8 a cart stand with several shopping carts of a third embodiment,

FIG. 9 a detailed view of the shopping cart according to FIG. 8,

FIG. 10 a cart stand with several shopping carts of a fourth embodiment.

FIG. 1 shows a cart stand 10 for similarly configured shopping carts 11, 12, 13, 14, 15 of a shopping market. In a known way, the cart stand 10 is embodied as a lower frame with a roof 40, which is supported by posts 42. The cart stand 10 has a rectangular outline. On three sides, the cart stand 10 is limited by elements (not shown), so that the station 10 is accessible only through one entrance.

The shopping carts 12, 13, 15 have been placed properly in the cart stand. The shopping cart 11 has just been returned to the cart stand 10, but has not yet been properly positioned. The shopping cart 14 is located outside the cart stand 10. On the side of the cart stand 10 opposite the entrance, a camera module 62 is mounted, having a viewing direction that points towards the entrance.

The shopping carts 11, 12, 13, 14, 15 are built with the same configuration. The different reference symbols for the individual shopping carts are used mainly in the following to define their position within a plurality of shopping carts.

As the direction of motion of the shopping cart, the direction is defined, in which the shopping cart moves when the user holds the shopping cart at the handle and pushes it forwards.

Correspondingly, the direction of motion of the shopping carts in FIGS. 1, 2, and 4 is from left to right and in FIGS.

6–10 from right to left. The illustration in FIG. 3 shows the shopping cart moving towards the viewer.

The shopping cart in FIG. 2 has a frame 18 that can be moved on rollers 16. A pushing handle 20 and a basket 24 are mounted on the frame 18. A rear end of the shopping cart 14 is defined by the pushing handle 20. The basket 24 limits the loading space and is formed of two side walls 26, a front end wall 27, a base 30, and a rear wall 29. The rear wall 29 is embodied in a known way as a flap that can pivot about a horizontal axis 8, which allows the shopping carts 11, 12, 13, 14, 15 to be pushed one into the other in a known way. Pushing the carts one into the other produces a high packing density of properly positioned shopping carts 12, 13, 15 in the cart stand 10.

A plate 32 is provided, which is mounted in the illustrated example so that it can pivot on the base 30 of the basket 24. An individual marking 36 can be located on the plate 32. The plate 32 can be changed from a first, active state, in which the marking 36 is clearly visible, to a second, passive state, in which the marking 36 is not visible.

In the illustrated example, the plate is mounted on the lower side of the basket 24 so that it can pivot and in the active state it hangs downward essentially perpendicular. In the passive state, the plate 32 contacts the base 30 of the basket almost horizontally. In the active state, the plate 32 projects beyond the silhouette of the basket 24. The marking 36 attached to the plate 32 is easily visible in the active state, especially directly or slightly askew from the front even when other shopping carts, whose plates 32 have assumed the passive state, are located in front of the shopping cart.

FIG. 3 shows the shopping cart as explained above viewed from the front. The plate 32 is shown in the active state.

The marking 36 is provided in the illustrated example in the form of a four-line bar code. The bar code can represent arbitrary alphanumeric symbols, with reference to which the shopping cart can be unambiguously identified. However, other markings are also conceivable, e.g., symbols or two-dimensional dot or bar codes, as known in great numbers for image-recognition processes.

Likewise, it is conceivable to use for the identification of individual shopping carts other types of markings, e.g., transponders or resonators, which can be changed from an active state, in which they transmit or send back signals, into a passive state, in which they do not transmit or send back signals.

The marking of each shopping cart is preferably unique, so that each shopping cart can be identified unambiguously.

In the following, reference is made again to the situation in FIG. 1. The plates 32 and 32*a* have a different position. The plate 32 is located in the passive state and the plate 32*a* is located in the active state. The last shopping cart in the row is the shopping cart 11.

In the illustrated example, the plate 32 on the shopping cart is tilted away when the shopping cart has been pushed completely into the other shopping cart. The shopping carts 12, 13, 15 have already been pushed completely in each other, and the plates 32 mounted on this shopping carts are tilted away and not recognized by the camera 62. Because the plates 32 are tilted away, they clear the view path to the plate 32*a* mounted on the shopping cart 11.

The view from the camera module 62 to the marking 36 of the shopping cart 11 mounted on the plate 32*a* is also not impaired by any other parts of the shopping carts in front of it in the row.

At the same time as the proper placement of the shopping cart 11, the plate 32*a* mounted on the cart is also tilted away and the marking located on the plate is no longer visible for the camera 62.

This change from one state, in which a marking is visible, into a different state, in which the marking is no longer visible, can be interpreted as an indicator for proper placement of the shopping cart 11. Depending on this, the person, who has properly placed the shopping cart, can be issued a bonus.

The first shopping cart 13, which has been placed in a cart stand 10, has no predecessor, in which it can be pushed. So that the plate 32 of this shopping cart 13 can be brought into the passive state nevertheless, an activation device 56 is provided.

In FIG. 5, the cart stand 10 is illustrated in the viewing direction towards the entrance of the cart stand 10. The cart stand 10 is provided for holding two rows of shopping carts. In the illustrated example, shopping carts are located only in the left row 50. There are no shopping carts in the right row. The two rows are separated from each other by guide rails 54. The guide rails 54 simultaneously guarantee a straight-line arrangement of the shopping carts in the row 50.

At the end of the rows, a crossbar 44 is mounted. A camera module 62 can be seen in the region of the right row. Another camera module is also located at the end of the left row but in this view it is covered by the flap 32.

Each camera module 62 is equipped with at least one image sensor 64 and an illumination module 86. The camera modules 62 are aligned so that they can detect the marking 36 on the plate 32 hanging down under the baskets 30 of the shopping carts 11, 12, 13, 14, 15 along the associated row of carts.

For this purpose, the camera modules 62 are preferably mounted so that they are arranged horizontally and vertically in the corresponding row flush with the plates 32 hanging down from the shopping carts. Therefore, the image sensors 64 can detect the image of the marking 36 with the least possible interference.

To be able to detect shopping carts on the entire length of the row, three image sensors 64*a*, 64*b*, and 64*c* are provided in the illustrated camera module 62, which are each equipped with a different objective, so that each of the image sensors 64 covers a different viewing angle and a different range.

For a given size of the marking 36 on the plates 32, the viewing angle of the first image sensor 64*a* is preferably selected so that it still detects the marking 36 on an active plate 32 of a shopping cart completely even if this shopping cart is at the shortest distance to the first image sensor 64*a* given by the setup of the cart stand 10. The maximum range of the first image sensor 64*a* is then given by the range, for which the image of a marking 36 is still large enough that it can still be resolved by this image sensor 64*a*. This maximum permissible range is limited not only by the resolution of the image sensor 64*a* but also by the zone of sharp focus and the quality of the optics.

The viewing angle of the second image sensor 64*b* is selected in turn so that it can still completely detect a marking 36 at the maximum permissible range for the first image sensor under consideration of the already mentioned tolerances. The maximum permissible range of a marking 36 in the second image sensor 64*b* is in turn limited by these same conditions as in the first image sensor 64*a*. Starting from this range, the marking 36 is detected by the third image sensor 64*c*.

In this way, the ranges of the three image sensors 64*a*, 64*b*, 64*c* border each other seamlessly, so that with a certain limited number of image sensors, every plate 32 on any shopping cart can be detected over the entire length of the row.

Preferably, the mentioned ranges are tuned to each other so that they have minimal overlap in order to guarantee reliable detection.

For detection, the image sensor is selected that delivers the best image. For this purpose, a control unit contained in the camera module, e.g., a micro-controller, can read the images of the three image sensors one after the other and test them for image contents that can be analyzed.

Preferably, the microcontroller can begin with the camera module that last supplied an image that can be analyzed, because it can be assumed that the next image will also originate again from this image sensor:

Either nothing has changed in the row of shopping carts or, when a shopping cart is added or removed, the new recognized plate is presumably now located in the vicinity of the last recognized plate and therefore is located with increased likelihood still at the range of this same image sensor.

The camera modules 62 are also equipped with illumination modules 66 for illuminating the plates 32, e.g., in the form of one or more IR LED arrays, which, if necessary, can be turned on preferably temporarily for the detection of a plate 32.

Optionally, additional illumination modules can be provided along the row 50, which can be mounted, e.g., on a lateral crossbar in order to be able to illuminate the plates 32 of shopping carts farther to the front sufficiently.

A central module 68, which is connected to the camera modules 62, is mounted on the post 42 at the entrance 48.

The central module 68 also has a reading and writing device 70 for data carriers of the customer and one or more output units 72, e.g., display, signal lamp, loudspeaker, or coupon printer.

Above each row of shopping carts, a display module 74 is mounted, which can display to the customer information on the illumination state of the corresponding row. The display modules 74 are connected to the central module 68 and controlled by this central module. The central module 68 provides, above all, information concerning the placed and removed carts and can display a message, e.g., "empty", by means of the display module 74 when in the corresponding row carts are no longer available, or "stop" when the row is full and therefore no more bonuses will be issued for additional carts.

When the customer returns the shopping cart to the cart stand 10, he moves the shopping cart 11 through the entrance 48 into the detection range of the image sensors 64. The marking 36 of the plate 32*a* is detected and the number of the shopping cart is recognized. The central module 68 has a list of the numbers of the shopping carts 12, 13, 15 for the moment located in its cart stand 10. With the help of this list, it is possible to recognize whether a shopping cart has been returned or removed. The central module 68 compares the current recognized number with the numbers stored in the list. If the current recognized number is present in the list, then this means that the shopping cart with this number was removed from the row, so this number is then deleted from the list. If the number is not on the list, then the shopping cart has been newly added to the row. The number of the newly added shopping cart is stored on the list and a bonus can be issued.

So that the detection range of the image sensors 64*a*, 64*b*, 64*c* is free again for the next incoming shopping cart, when the newly added shopping cart is completely pushed in properly, the identification identifier is again set to the passive state. This occurs by the plate 32 being pivoted into a horizontal position. Thus, the bonus can be issued only when the change from the active state to the passive state is recognized.

Optionally, it can also be detected by the detection means, in which size the marking 36 is imaged on the corresponding image sensors 64*a*, 64*b*, 64*c* and this information can be used to obtain the range between the shopping cart and the camera module 62. Thus it is possible, on one hand, to determine the number of shopping carts 12, 13, 15 in this row. This information can be used, e.g., to limit the length of the row 50 by displaying to the customer the fact that no more shopping carts should be placed in this row 50 and/or that no more bonuses will be issued for shopping carts placed in this row 50 by means of the display module 74 over the corresponding row.

On the other hand, it can be determined, e.g., whether the shopping cart 11 has actually been placed properly, i.e., whether it has been pushed completely into the shopping cart 15 in front of it. For this purpose, e.g., in the central module 68, the range can be stored, at which the marking 36 of the shopping cart 15 was detected. Then it can be tested whether the newly added shopping cart 11 is close enough to the expected range, i.e., within a tolerance range.

The advantage in this embodiment is that a shopping cart 11 can already be recognized as soon as it is located in the corresponding row 50 in the detection range of the camera module, before it is pushed into the last shopping cart 15 of the row 50. Through dynamic evaluation of the change in size of the image of the marking 36, it can also be registered whether the shopping cart 11 is moving towards or away from the row 50, i.e., whether it is being returned or removed.

In FIGS. 6 and 7, a second embodiment of the invention is shown. In contrast to the previously described embodiment, the state of the marking of each shopping cart is changed not when it is pushed into a shopping cart in front of it, but instead only when a subsequent shopping cart is pushed in.

In the illustrated example, the marking of the last shopping cart 15 of a row is always in the active state and is first set into a passive state when the subsequent shopping cart 11 is pushed in.

This can be realized as explained, e.g., with reference to FIG. 6, such that when the shopping cart 11 is pushed into the shopping cart 15 a mechanical device tilts the plate 32 of the shopping cart 15, so that the marking 36 on the plate 32 can no longer be recognized by the camera. At the same time as the tilting of the plate 32, the view of the camera 62 on the plate 32*a* of the newly added shopping cart 11 to the row is possible.

The marking of the last shopping cart is in the active state as long as no other shopping cart is pushed in.

Through corresponding mechanical means, the change to a different state takes place only when the next shopping cart 11 has been completely pushed into the shopping cart 15 in front of it. Only after this time can another newly added shopping cart be recognized.

If the returned shopping cart 11 has not been properly pushed into the preceding shopping cart 15, it cannot be recognized and a bonus is not issued.

This has the positive effect that a person returning the shopping cart 11 pays attention that all shopping carts of the row are pushed into each other properly. Thus, a high packing density of the shopping carts is always generated.

In one possible embodiment of the mechanical means shown in detail in FIG. 7, a catch pin 82 is provided on the plate 32, which projects through the base 30 of the basket 24 into the loading space of the shopping cart 15.

When a subsequent shopping cart 11 is pushed in, the base 30*a* of the subsequent shopping cart 11 engages the catch pin 82 and thus pivots the plate 32 into its passive position. This passive position is shown with dashed lines and designated with "A."

Thus, the camera module 62 always sees only the plate 32 of the last shopping cart 15 in a row until a new shopping cart 11 is added or until the last shopping cart is removed again.

When the last shopping cart 11 of the row is removed again, the state of the marking 32 on the previously next-to-last and now last shopping cart 15 changes to the active state.

This embodiment has the advantage that the plates 32 are at rest during the detection and therefore can be detected more easily. In addition, the time, during which the marking 36 can be detected, is longer than in the first embodiment, because the plate 32 remains in the detection range of the camera module 62 until the next shopping cart has been pushed in. This has the consequence that the detection processes must be performed less frequently, which can save energy. This is especially important when the cart stand is powered by batteries or solar cells.

In FIGS. 8 and 9, a third embodiment is shown. In this third embodiment, the plate 32 is mounted so that the plate 32*a* is not activated for a free-standing shopping cart 11, but instead it is activated only when the cart is pushed into the shopping cart 15 in front of it. At the same time, the plate 32 of the shopping cart 15, which was previously the last shopping cart and is now the next-to-last shopping cart, is changed from the active to the passive state.

FIG. 9 shows in a detailed illustration the region of the plate 32 from FIG. 8. Pressure is exerted on the plate 32 by a torsion spring 84 into a first position "A." In position "A" the plate 32 is in the passive state. When the shopping cart is pushed into another shopping cart, the free end of the plate 32 contacts the base of the shopping cart in front and the plate is pivoted about its pivot axis into a vertical position "B." In position "B" the plate 32 is in the active state. In position "B" the catch lever 82 projects into the basket. The marking on the plate can be recognized by the camera 62. Now if another shopping cart is pushed in, it contacts the catch lever 82 and pivots the plate 32 into the position "C." In position "C," the plate 32 is back in a passive state.

FIG. 10 shows a fourth embodiment, in which the plates 32 are mounted approximately at the height of the track rollers under the loading surface of the shopping cart 11, 13, 15. The camera 62 is located just over the base between the track rollers. Here, the shopping cart can be pushed freely away from the camera 62 towards the front.

This has the advantage that shopping carts can be removed not only from the end of the row, but also at the beginning of the row.

For removing the shopping cart from the beginning of the row, the embodiment described under FIGS. 6 and 7 is well suited, in which the plate 32 of the shopping cart is deactivated until another shopping cart is pushed in.

If the shopping cart 13 is taken from the beginning of the row, this has the same effect on the plate 32 as when a shopping cart pushed into the shopping cart from behind is again removed and the plate 32 assumes the active state. The marking of the shopping cart 13 removed towards the front is now recognized by the camera 62.

In this embodiment, the shopping cart can be removed from the front of the row and returned to the row from the back. This results in a backwards wandering row.

The system can determine how many shopping carts have been removed from the front and thus calculate the space at the front end of the stack. In this embodiment, the customer can receive a bonus or even an additional bonus when he pushes the entire stack forwards when pushing in the returned shopping cart. In this way, the backwards "wandering" of the stack can be compensated.

To prevent customers from manipulating the system by visiting the cart stand with a still full shopping cart after completing his shopping, receiving the bonus, then going to his car with the shopping cart, and then leaving the cart, another criteria is that a bonus is only credited when the shopping cart is returned empty.

For example, the plates 32 can be provided so that the plates 32 of the shopping cart tilt as soon as goods are placed in the shopping cart. If the shopping cart is returned with goods in the basket and pushed into the last shopping cart, this does create a "deactivation" of the marking on the previous shopping cart, but because the plate 32 of the pushed in cart is blocked in the passive position, no return is recognized and no bonus is issued.

Another possibility for manipulation by the customer is that he can remove the shopping cart and then shortly after push the cart back into the cart stand and then receive a bonus, without having used the shopping cart for shopping. To counteract this type of misuse, it is possible to make the bonus dependent on the time span between the removal and the return of the shopping cart. A bonus is issued only after the expiration of a certain time span. It is also conceivable to make the value of the bonus also dependent on the duration of this time span and thus to reward customers, who were in the shopping market longer, with higher bonuses.

The return or removal of a shopping cart is recognized in the described embodiments with reference to a marking that can be detected with optical means and that can be changed with purely mechanical means from an active state to a passive state and vice-versa.

This optical recognition in combination with the mechanically resolved state change offers a series of advantages:

The markings and plates on the shopping carts can be manufactured economically and replaced without great expense. They can also be provided without their own power supply. The presence of a marking on the shopping cart and the mechanical function of the plates can be checked with simple means, which results in low maintenance costs.

In the scope of the invention, optical markings of the shopping carts are also conceivable, which manage without mechanical means for state changes from active to the passive state and vice-versa: in the simplest case, a marking, which can be read from above or below, can be mounted on the base of the shopping cart. These markings are exactly covered by a subsequent shopping cart in a nested row and thus changed into a passive state when the two relevant shopping carts are pushed one into the other properly. Thus, any mechanical parts for switching the marking are not necessary.

However, it is also possible to use a marking that includes electronic components.

Here, both passive electronic markings operating without their own power supply or also active markings operating with their own power supply can be used.

A passive electronic marking is, e.g., a so-called transponder. For the use of transponders, the transponders can transmit different strength "answer signals" dependent on position.

It is also possible to use the shielding properties of the metal basket on the shopping cart and to arrange, e.g., the transponder either inside or outside the basket according to the state.

With reference to the different strength answer signals of the transponder, it can be differentiated between the "active" or "inactive" state of the marking.

For active electronic markings, such as small transmitters, these can be changed to an active or inactive state by switches mounted on the shopping cart.

As another conceivable marking with electronic components, e.g., LCD displays can be used. As an alternative to markings on tilting plates, the identification features belonging to a shopping cart can be displayed on the LCD display. The LCD display can change its display state according to whether the shopping cart is standing alone, whether the shopping cart has been pushed into a preceding shopping cart, or whether a subsequent shopping cart has been pushed in. The display can consist, e.g., of a transparent LCD display, which is mounted under the base of the basket.

The inactive state of the identification markings can be manufactured such that the displays are switched to be transparent. In contrast, in the active state, they are opaque and show the identification feature of the corresponding shopping cart.

Obviously, the system can also be used in addition to the described system for shopping carts for any other type of transport cart made available temporarily.

The invention claimed is:

1. System for detecting and rewarding the return of a shopping cart or luggage cart taken from a cart stand, with a number of shopping carts (11, 12, 13, 14, 15), the system comprising each of the carts being provided with a non-contact, individual marking (32, 32*a*) that can be identified, at least one cart stand (10) for the shopping carts, and detection means (62, 64) arranged in the region of the cart stand for the markings of the shopping carts, the detection means being equipped so that the detection means generate a signal for issuing a bonus when a returned shopping cart is identified, wherein the markings (32, 32*a*) of the shopping carts (11, 12, 13, 14, 15) are changeable from an active state, in which the marking can be identified by the detection means (62, 64), to a passive state, in which the marking cannot be identified by the detection means, or vice-versa.

2. System according to claim 1, wherein the markings (32, 32*a*) of the shopping carts (11, 12, 13, 14, 15) can be identified optically and the detection means (62, 64) are optical detection means.

3. System according to claim 1, wherein the markings (32, 32*a*) of the shopping carts (11, 12, 13, 14, 15) are equipped so that the markings change from the active to the passive state or from the passive to the active state in connection with the return of the shopping carts to the cart stand (10).

4. System according to claim 3, wherein the markings (32, 32*a*) of the shopping carts (11, 12, 13, 14, 15) are formed so that the change from the active state to the passive state or from the passive state to the active state takes place when the returned shopping cart (11) is placed within a predetermined tolerance in a row of nested ones of the shopping carts (12, 13, 15) in the cart stand (10).

5. System according to claim 1, wherein the marking (32) of a separated one of the shopping carts (14), which is not in a row of nested ones of the shopping carts (12, 13, 15), is in the active state.

6. System according to claim 5, wherein the markings (32, 32*a*) of the shopping carts (11, 12, 13, 14, 15) are formed so that the marking (32) of a first one of the shopping carts (15) changes from the active state to the passive state when a second one of the shopping carts (11) behind the first shopping cart (15) is pushed into the first shopping cart (15) for forming or adding to a nested row.

7. System according to claim 5, wherein the markings (32, 32*a*) of the shopping carts (11, 12, 13, 14, 15) are provided so that the marking (32*a*) of a second one of the shopping carts (11) changes from the active state to the passive state when the second shopping cart (11) is pushed into a first one of the shopping carts (15) in front of it for forming or adding to a row of nested ones of the shopping carts.

8. System according to claim 1, wherein the markings (32, 32*a*) of the shopping carts (11, 12, 13, 14, 15) are provided so that the marking (32*a*) of a separated, second one of the shopping carts (11), which is not in the row of nested shopping carts, is in the passive state, with the marking changing to the active state when the second shopping cart (11) is pushed into a first one of the shopping carts (16) in front of it.

9. System according to claim 1, wherein the markings (32, 32*a*) of the shopping carts (11, 12, 13, 14, 15) are provided so that the marking (32) of a separated, second one of the shopping carts (15), which is not in a row of nested ones of the shopping carts, is in the passive state, with the marking then changing to the active state when the second shopping cart (15) is pushed into a first one of the shopping carts (12) in front of it and changing back into the passive state when a third one of the shopping carts (11) located behind the second shopping cart (15) is pushed into the second shopping cart (15).

10. System according to claim 1, wherein a state of the marking (32) of a non-empty one of the shopping carts (14) always remains constant.

11. System according to claim 10, wherein a state of the marking (32) of a non-empty one of the shopping carts (14) is always passive.

12. System according to claim 1, wherein the marking (32, 32*a*) of the shopping carts (11, 12, 13, 14, 15) is formed by a pivoting plate.

13. System according to claim 12, wherein the plate is mounted so that it can pivot on a base (30) of the shopping cart (11, 12, 13, 14, 15).

14. System according to claim 12, wherein the plate is mounted on a tilting rear wall (29) of the shopping cart (11, 12, 13, 14, 15).

15. System according to claim 1, wherein the marking (32, 32*a*) of the shopping cart (11, 12, 13, 14, 15) comprises a transponder.

16. System according to claim 1, wherein there are separate detection means (62) for each row of nested shopping carts (12, 13, 15) formed in the cart stand (10).

17. System according to claim 1, wherein the detection means (62) recognize when the cart stand (10) is completely full.

18. System according to claim 1, wherein the detection means (62) recognize when the cart stand (10) is empty.

19. System according to claim 17, wherein there are several cart stands (10) and each of the cart stands (10) is provided with display elements (74), which are connected to the detection means (62) and which display to an outside area when the cart stand (10) is empty and/or completely full.

20. System according to claim 19, wherein the detection means (62) of the individual cart stands (10) are connected to each other for data exchange.

21. System according to claim 2, wherein the detection means (62) contain at least one camera (64).

22. System according to claim 21, wherein several cameras (64, 64*b*, 64*c*) are provided for different detection ranges, especially distance ranges.

23. System according to claim 2, wherein the detection means (62) are provided with illumination means (66).

24. System according to claim 23, wherein the detection means comprise at least one camera and the camera(s) (64*a*, 64*b*, 64*c*) or the illumination means (66) are triggered by a motion detector.

25. Method for detecting and rewarding the return of a shopping cart or luggage cart taken from a cart stand, with each shopping cart being identified using non-contact means with reference to an individual marking by detection means in the region of the cart stand, and with the issuing of a bonus being generated when a shopping cart is returned to a cart stand, comprising changing the markings of the shopping carts in connection with the return to a cart stand from an active state, in which the marking can be identified by the detection means, to a passive state, in which the marking cannot be identified by the detection means, or vice-versa.

* * * * *